US010484801B2

(12) United States Patent
Wernaers et al.

(10) Patent No.: US 10,484,801 B2
(45) Date of Patent: Nov. 19, 2019

(54) CONFIGURATION OF HEARING PROSTHESIS SOUND PROCESSOR BASED ON VISUAL INTERACTION WITH EXTERNAL DEVICE

(71) Applicant: Cochlear Limited, Macquarie University (AU)

(72) Inventors: Yves Wernaers, Teralfene (BE); Tom Van Assche, Brussegem (BE)

(73) Assignee: Cochlear Limited, Macquarie University, NSW (AU)

( * ) Notice: Subject to any disclaimer, the term of this patent is extended or adjusted under 35 U.S.C. 154(b) by 173 days.

(21) Appl. No.: 14/851,900

(22) Filed: Sep. 11, 2015

(65) Prior Publication Data

US 2016/0088406 A1 Mar. 24, 2016

Related U.S. Application Data

(60) Provisional application No. 62/052,855, filed on Sep. 19, 2014.

(51) Int. Cl.
*H04R 25/00* (2006.01)
*H04S 7/00* (2006.01)

(52) U.S. Cl.
CPC ..... *H04R 25/505* (2013.01); *H04S 7/303* (2013.01); *H04R 2225/41* (2013.01); *H04R 2225/43* (2013.01); *H04R 2225/49* (2013.01)

(58) Field of Classification Search
CPC ..... H04R 25/505
USPC ..... 381/71.1, 71.14, 73.1, 94.1, 94.5, 94.7, 381/317
See application file for complete search history.

(56) References Cited

U.S. PATENT DOCUMENTS 6,707,921 B2 * 3/2004 Moore ..... G02C 11/06 381/327
7,853,030 B2 12/2010 Grasbon et al.
8,768,479 B1 7/2014 Hood et al.
(Continued)

FOREIGN PATENT DOCUMENTS

WO WO 2013/089693 6/2013

OTHER PUBLICATIONS

Dawn Chmielewski, "Next-Generation Hearing Aids Tune in to the iPhone," printed from the World Wide Web, https://recode.net/2014/04/18/next-generation-hearing-aids-tune-in-to-the-iphone/, dated Apr. 18, 2014.

(Continued)

*Primary Examiner* — Yosef K Laekemariam
(74) *Attorney, Agent, or Firm* — Pilloff Passino & Cosenza LLP; Martin J. Cosenza

(57) ABSTRACT

As disclosed, an external device is associated with the recipient of a hearing prosthesis and provides to the hearing prosthesis a control signal carrying an indication that the recipient is looking at output of the external device, perhaps including an indication of one or more characteristics of visual output and/or audio output from the external device. In response to such a control signal, the hearing prosthesis then automatically configures its sound processor in a manner based at least in part on the provided indication, such as to help process audio coming from the external device and/or to process audio in a manner based on the indicated characteristic(s) of visual output and/or audio output.

33 Claims, 4 Drawing Sheets

(56) References Cited

U.S. PATENT DOCUMENTS

| | | | | |
|---|---|---|---|---|
| 2013/0004000 | A1 | 1/2013 | Franck | |
| 2013/0085549 | A1 | 4/2013 | Case et al. | |
| 2013/0190044 | A1* | 7/2013 | Kulas | G06F 3/041 455/556.1 |
| 2013/0345775 | A1 | 12/2013 | Davidsson et al. | |
| 2014/0105433 | A1 | 4/2014 | Goorevich et al. | |
| 2014/0172042 | A1 | 6/2014 | Goorevich et al. | |
| 2014/0355798 | A1* | 12/2014 | Sabin | H04R 25/50 381/314 |
| 2015/0289062 | A1 | 10/2015 | Ungstrup et al. | |
| 2015/0289064 | A1 | 10/2015 | Jensen et al. | |

OTHER PUBLICATIONS

TruLink, "TruLink connects Your Hearing Aids With Your iPhone," http://www.trulinkhearing.com/trulink-control-app#memories, printed from the World Wide Web on Jun. 10, 2014.
Written Opinion and International Search Report from International Application No. PCT/IB2015/001962, dated Feb. 22, 2016.
Written Opinion and International Search Report from International Application No. PCT/IB2015/001961, dated Feb. 22, 2016.
Office Action from U.S. Appl. No. 14/851,893, dated Nov. 3, 2016.

* cited by examiner

CONFIGURATION OF HEARING PROSTHESIS SOUND PROCESSOR BASED ON VISUAL INTERACTION WITH EXTERNAL DEVICE

REFERENCE TO RELATED APPLICATION

This application claims priority to U.S. Patent Application No. 62/052,855, filed Sep. 19, 2014, the entirety of which is hereby incorporated by reference. In addition, the entirety of U.S. Patent Application No. 62/052,855, filed Sep. 19, 2014, is also hereby incorporated by reference.

BACKGROUND

Unless otherwise indicated herein, the description provided in this section is not prior art to the claims and is not admitted to be prior art by inclusion in this section.

Various types of hearing prostheses provide people having different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural signals, or any other part of the ear, auditory nerve, or brain that may process the neural signals.

People with some forms of conductive hearing loss may benefit from hearing devices such as hearing aids or electromechanical hearing devices. A hearing aid, for instance, typically includes at least one small microphone to receive sound, an amplifier to amplify certain portions of the detected sound, and a small speaker to transmit the amplified sounds into the person's ear. An electromechanical hearing device, on the other hand, typically includes at least one small microphone to receive sound and a mechanism that delivers a mechanical force to a bone (e.g., the recipient's skull, or middle-ear bone such as the stapes) or to a prosthetic (e.g., a prosthetic stapes implanted in the recipient's middle ear), thereby causing vibrations in cochlear fluid.

Further, people with certain forms of sensorineural hearing loss may benefit from hearing prostheses such as cochlear implants and/or auditory brainstem implants. Cochlear implant systems, for example, make use of at least one microphone (e.g., in an external unit or in an implanted unit) to receive sound and have a unit to convert the sound to a series of electrical stimulation signals, and an array of electrodes to deliver the stimulation signals to the implant recipient's cochlea so as to help the recipient perceive sound. Auditory brainstem implant systems use technology similar to cochlear implant systems, but instead of applying electrical stimulation to a person's cochlea, they apply electrical stimulation directly to a person's brain stem, bypassing the cochlea altogether, still helping the recipient perceive sound.

In addition, some people may benefit from hearing prostheses that combine one or more characteristics of the acoustic hearing aids, vibration-based hearing devices, cochlear implants, and auditory brainstem implants to enable the person to perceive sound.

SUMMARY

Hearing prostheses such as these or others may include a sound processor configured to process received audio input and to generate and provide corresponding stimulation signals that either directly or indirectly stimulate the recipient's hearing system. In practice, for instance, such a sound processor could be integrated with one or more microphones and/or other components of the hearing prosthesis and may be arranged to digitally sample the received audio input and to apply various digital signal processing algorithms so as to evaluate and transform the receive audio into appropriate stimulation output. In a hearing aid, for example, the sound processor may be configured to amplify received sound, filter out background noise, and output resulting amplified audio. Whereas, in a cochlear implant, for example, the sound processor may be configured to identify sound levels in certain frequency channels, filter out background noise, and generate corresponding stimulation signals for stimulating particular portions of the recipient's cochlea. Other examples are possible as well.

In general, the sound processor of a hearing prosthesis may be configured with certain operational settings that govern how it will process received audio input and provide stimulation output. By way of example, the sound processor may be configured to sample received audio at a particular rate, to apply certain gain (amplification) tracking parameters so as to manage resulting stimulation intensity, to reduce background noise, to filter certain frequencies, and to generate stimulation signals at a particular rate. In some hearing prostheses, these or other sound processor settings may be fixed. Whereas, in others, the settings may be dynamically adjusted based on real-time evaluation of the received audio, such as real-time detection of threshold noise or volume level in certain frequency channels for example.

The present disclosure addresses a particular scenario where a recipient of a hearing prosthesis is likely to be looking at an external device such as a mobile phone, television, portable computer, or appliance, for instance, from which the hearing prosthesis may receive audio. In that scenario, the fact that the recipient is likely to be looking at the external device may suggest that the recipient is currently focused on listening to audio from the external device in particular. Consequently, in such a scenario, the present disclosure provides for automatically configuring the sound processor of the recipient's hearing prosthesis in a manner that may help facilitate processing of audio coming from the external device.

In accordance with the disclosure, the external device may be associated with the recipient of the hearing prosthesis, such as by being wirelessly paired with the recipient's hearing prosthesis, by being in local communication with a control unit that is also in local communication with the recipient's hearing prosthesis, or otherwise by being in communication with the hearing prosthesis. In practice, the hearing prosthesis may then receive directly or indirectly from the external device a control signal that indicates that the recipient is looking at an output of the external device, and the hearing prosthesis would then automatically configure its sound processor in a manner based at least in part on the indication that the recipient is looking at the output of the external device, such as in a manner that may help to process sound coming from the external device in particular.

The control signal indicating that the recipient is looking at the output of the external device may then be based on a determination by the external device that the recipient is actually looking at the external device (such as by the external device applying eye-tracking technology to detect that the recipient is actually looking at an output display of the external device). Alternatively or additionally, the control signal indicating that the recipient is looking at the output of the external device may be based on a determination by the external device that the external device is outputting visual content, especially visual content of a type that the recipient is likely to be looking at (e.g., text-based content, or video media content), thereby leading to a conclusion that the recipient is likely looking at the visual content being output (i.e., being output or about to be output).

Further, the control signal may provide the indication in any form that hearing prosthesis would be configured to respond to as presently disclosed. For instance, the control signal could provide the indication as a simple Boolean flag that indicates whether the recipient is looking at the output of the external device (i.e., actually or likely), and the hearing prosthesis may be programmed to respond to such a control signal indication by configuring its sound processor to process audio coming from the external device in particular. Alternatively or additionally, the control signal could provide the indication at least in part by indicating that the external device is outputting visual content and perhaps by indicating one or more characteristics of the visual content being output, and the hearing prosthesis may be programmed to respond to such a control signal indication by configuring its sound processor to process audio of a type that would likely be associated with visual content having the indicated one or more characteristics.

Accordingly, in one respect, disclosed herein is a method operable by a hearing prosthesis to facilitate such functionality. According to the method, the hearing prosthesis receives, from an external device associated with a recipient of the hearing prosthesis, a control signal indicating that the recipient is looking at an output of the external device. Further, in response to receipt of the control signal, the hearing prosthesis then automatically configures a sound processor of the hearing prosthesis in a manner based at least in part on the control signal indicating that the recipient is looking at the output of the external device.

In another respect, disclosed is a hearing prosthesis that includes at least one microphone for receiving audio input, a sound processor for processing the audio input and generating corresponding hearing stimulation signals to stimulate hearing in a human recipient of the hearing prosthesis, and a wireless communication interface. In practice, the wireless communication interface of the hearing prosthesis may be configured to receive wirelessly, from an external device associated with the recipient, a control signal indicating that the recipient is focused at least visually on an output of the external device. Further, the hearing prosthesis may be configured to respond to the receipt of such a control signal by automatically configuring the sound processor in a manner based at least in part on the control signal indicating that the recipient is focused at least visually on the output of the external device. In this manner, the automatic configuring of the sound processor may thus accommodate processing of the audio input when the audio input comprises audio content output from the external device.

In addition, in still another respect, disclosed is a system that includes a hearing prosthesis and a computing device associated with a recipient of the hearing prosthesis. In the disclosed system, hearing prosthesis includes a sound processor for processing received audio input and generating hearing stimulation signals for the recipient of the hearing prosthesis. Further, the computing device may be configured to output visual content for viewing by the recipient, and the computing device may be configured to transmit to the hearing prosthesis a control signal indicating that the recipient is looking in a direction of the computing device. Further, the hearing prosthesis may be configured to automatically configure the sound processor in a manner based at least in part on the control signal indicating that the recipient is looking in the direction of computing device.

These as well as other aspects, advantages, and alternatives will become apparent to those of ordinary skill in the art by reading the following detailed description, with reference where appropriate to the accompanying drawings. Further, it should be understood that the description throughout by this document, including in this summary section, is provided by way of example only and therefore should not be viewed as limiting.

DETAILED DESCRIPTION

Figure 1:
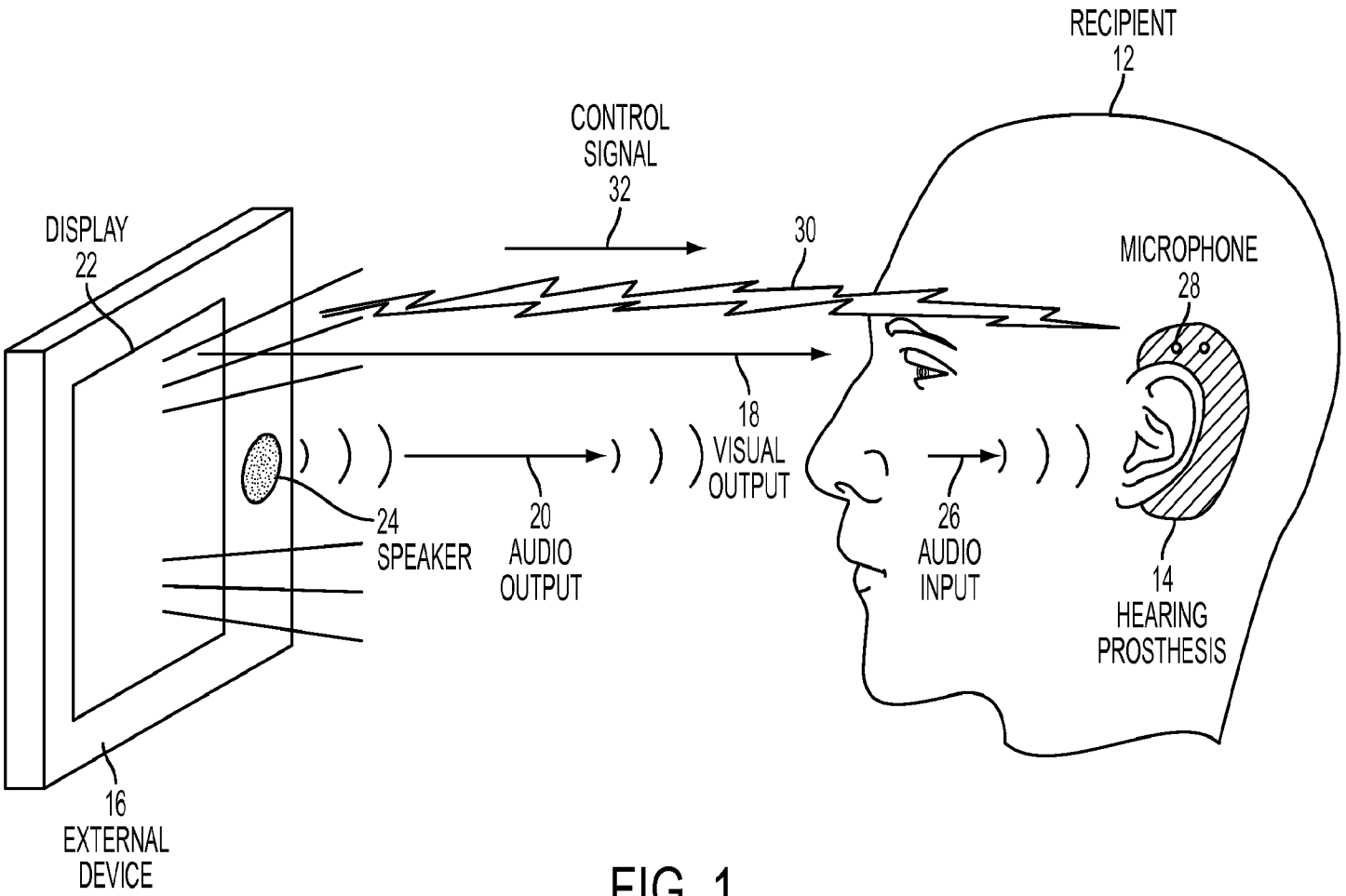
FIG. 1 is a simplified illustration of an example system in which features of the present disclosure can be implemented.

Referring to the drawings, as noted above, FIG. 1 is a simplified illustration of an example system in which features of the present disclosure can be implemented. In particular, FIG. 1 depicts a hearing prosthesis recipient 12 fitted with a hearing prosthesis 14, and further depicts an external device 16 that is providing both visual output 18 from a display 22 and audio output 20 from a speaker 24. As shown, the recipient in this example arrangement is looking at the external device, such as to view the visual output being provided by the display of the external device. Further, the audio output from the speaker of the external device is shown arriving as audio input 26 at a microphone or other sensor 28 of the hearing prosthesis, so that the hearing prosthesis may receive and process the audio input to stimulate hearing by the recipient.

It should be understood that the arrangement shown in FIG. 1 is provided only as an example, and that many variations are possible. For example, although the figure depicts the external device providing audio output from a speaker and the audio output arriving as audio input at the ear of the recipient, the external device could instead provide audio to the hearing prosthesis through wireless data communication, such as through a BLUETOOTH link between radio in the external device and a corresponding radio in the hearing prosthesis. Alternatively, the external device might provide no audio output to the hearing prosthesis, as may be the case, for instance, if the external device is merely displaying visual content (such as image-capture data, text message data, or the like). Further, as another example, although the figure depicts the hearing prosthesis with an external behind-the-ear component, which could include one or more microphones and a sound processor, the hearing prosthesis 14 could take other forms, including possibly being fully implanted in the recipient and thus having one or more microphones and a sound processor implanted in the recipient rather than being provided in an external component. Other examples are possible as well.

In line with the discussion above, the external device in this arrangement may be associated with the recipient of the hearing prosthesis, such as by having a defined wireless communication link 30 with the hearing prosthesis for instance. In practice, such a link could be a radio-frequency link or an infrared link, and could be established using any of a variety of air interface protocols, such as BLUETOOTH, WIFI, or ZIGBEE for instance. As such, the external device and the hearing prosthesis could be wirelessly paired with each other through a standard wireless pairing procedure or could be associated with each other in some other manner, thereby defining an association between external device and the recipient of the hearing prosthesis. Alternatively, the external device could be associated with the recipient of the hearing prosthesis in another manner.

FIG. 1 additionally depicts a control signal 32 passing over the wireless communication link from the external device to the hearing prosthesis. In accordance with the present disclosure, such a control signal may provide the hearing prosthesis with an indication that the recipient is looking at an output of the external device, e.g., that the recipient is visually focused on the external device. As noted above, the hearing prosthesis would then respond to such an indication by configuring one or more operational settings of its sound processor, optimally to accommodate processing of the audio that is arriving from the external device.

In practice, the control signal indication that the recipient is looking at an output of the external device may be an indication that the recipient is actually looking at the output of the external device. For instance, the external device may be configured with a video camera and eye-tracking software in order track the recipient's eyes and to determine when the recipient is actually looking at a display of the external device. When the external device thereby determines that the recipient is actually looking at the display of the external device, the external device may then responsively transmit to the hearing prosthesis a control signal that indicates that the recipient is actually looking at the output of external device.

Such an indication could explicitly specify that the recipient is actually looking at the output of the external device, by including a Boolean flag, code, text, or one or more other values that the hearing prosthesis is programmed to interpret as an indication that the recipient is looking at the external device, or at least to which the hearing prosthesis is programmed to respond by configuring its sound processor in a manner appropriate for when the recipient is looking at the device, namely to help facilitate processing of audio coming from the external device, or from a direction of the external device.

Alternatively or additionally, the control signal indication that the recipient is looking at the output of the external device could be an indication that the recipient is likely (i.e., probably) looking at the output of the external device. As noted above, such a control signal could address a scenario where the external device is currently outputting visual content of a type that the recipient is likely to be looking at, such as where the device is presenting video content, image/video capture content (e.g., still camera or video camera display), text or e-mail message content, gaming content, word processor content, or the like, particularly where the external device would present such visual content for viewing and/or interaction with the recipient (e.g., for the recipient to see presented video content, to engage in text or e-mail message exchange, to play a game, or to read and/or edit a word processing document). In practice, this may be the case when an application associated with presentation of such visual content is currently running in the foreground (i.e., in focus) on the external device, perhaps specifically when such an application is in a mode where it is currently presenting such visual content on a display of the external device, which may lead to a conclusion that the recipient is likely looking at the external device.

Thus, the external device could be programmed to detect when it is presenting visual content such as visual content of a type that the recipient is likely to be looking at, and/or when it is running an in-focus application of a type that outputs such visual content, and to responsively transmit to the hearing prosthesis a control signal that indicates that the recipient is likely looking at the output of external device.

Such a control signal could thus indicate that the recipient is looking at the output of device by indicating that the external device is currently outputting visual content, by indicating that the external device is currently outputting visual content of a type that the recipient would likely be looking at, and/or by indicating that the external device is currently running an in-focus application of a type that outputs and/or is outputting such visual content. Further, the control signal could specify particular such visual content and/or a particular such application that the hearing prosthesis would interpret to correspond to visual content of a particular type that the recipient is likely to be looking at and/or or otherwise to suggest that the recipient is likely to be looking at the external device. The hearing prosthesis would then be programmed to respond to such a control signal by configuring its sound processor in a manner appropriate for when the recipient is looking at the device, again to, e.g., help facilitate processing of audio coming from the external device.

In addition, the control signal could also indicate one or more characteristics of visual content that the external device is currently outputting, and the hearing prosthesis could be programmed to configure its sound processor based at least on the indicated one or more characteristics of the visual content. Certain types of visual content output by the external device may correspond with certain types of audio output from the external device, or perhaps with an absence of audio output from the external device. Thus, given knowledge of the type of visual content that the external device is currently outputting, the hearing prosthesis can advantageously configure its sound processor to accommodate processing of audio in a manner that corresponds with that type visual output.

Here again, the control signal indication could take various forms provided that the hearing prosthesis is programmed to interpret the indication as an indication of the one or more characteristics of the visual output. For instance, the indication could include a code, text, or one or more other values that the hearing prosthesis is programmed to interpret accordingly. Such an indication could directly specify the one or more characteristics of the visual output and/or could indicate the one or more characteristics in various ways, such as by indicating a class, name, or type of visual content, a class, name, or type of application that is outputting the visual content, or the like, and the hearing prosthesis could be programmed to interpret such an indication accordingly or at least to respond to such an indication by configuring its sound processor in a corresponding manner.

Thus, the sound processor settings that the hearing prosthesis responsively sets itself to use in response to an indication that the recipient is looking at the output of the device can depend on various characteristics of visual content being output by the external device, suggesting various types of recipient interaction with the external device.

By way of example, if the external device is currently outputting text-based content without any significant audio component, such as text message or e-mail message content, word processing content, news report content, or the like, an assumption that the recipient is concentrating on reading the output content on the device can be made. In that scenario, based at least in part on the control signal indicating that the visual content is text-based, the hearing prosthesis may thus responsively set its sound processor to reduce its gain (e.g., to provide less intense stimulation output in response to a given volume level of audio input) and perhaps to reduce its stimulation rate (e.g., to provide stimulation signals less often), so as to conserve power and reduce hearing stimulation to the recipient. Further, in that scenario, the hearing prosthesis may also responsively set its sound processor to increase noise reduction (e.g., by applying a wider noise filter, by increasing a signal-to-noise threshold that the hearing prosthesis uses to determine whether particular frequency bands should be suppressed, and/or by applying other such settings), in an effort to reduce background noise, to further help the recipient to better concentrate on reading the output text content.

Likewise, if the external device is currently outputting other types of visual content without any significant audio component, such as image-library content or the like, an assumption that the recipient is similarly concentrating on looking at that visual content on the device can be made. Thus, similarly in that scenario, the hearing prosthesis may responsively set its sound processor to reduce its gain and stimulation rate, and to increase its noise reduction.

As another example, if the device is currently outputting still or video image content when the device is being used to take pictures or record video, an assumption that the recipient is looking straight ahead in the direction of the device, essentially using the device as a still camera or video camera, can be made. In that scenario, based at least in part on the visual content including image-capture content, the hearing prosthesis may responsively set its sound processor to optimize audio input from a direction straight in front of the recipient's face. For instance, the hearing prosthesis may responsively set its sound processor to use a microphone-beamforming mode that focuses on any audio coming into the hearing prosthesis from straight ahead of the recipient's face. In such instances, the use of beamforming might be inconsistent with settings that the hearing prosthesis would otherwise have.

In addition, if the external device is currently outputting visual content with an associated audio component, such as video that includes an audio track, or gaming content that includes an audio track, the control signal could also indicate that, again in a manner that the hearing prosthesis is programmed to interpret as indicating that, and the hearing prosthesis could be programmed to configure its sound processor further based on that indication. When the external device is outputting visual content with associated audio content, an assumption that the recipient is looking straight ahead at the external device and that the relevant audio to be received by the recipient is coming from the device can be made. In that scenario, i.e., in response to such an indication, the hearing prosthesis may thus responsively set its sound processor to optimize audio input from a direction straight in front of the recipient's face and particularly at arm's length where the recipient is likely to be holding the device or at another distance where the output from the external device would likely be positioned from the recipient. For instance, the hearing prosthesis may responsively set its sound processor to use a microphone-beamforming mode that focuses on audio coming from straight ahead of the recipient's face at that likely distance (such by applying an appropriate set of filters to combine audio information from two input microphones to achieve a desired beamforming effect).

Further, the control signal that the external device provides to the hearing prosthesis in such a scenario could also indicate one or more characteristics of the audio content being output by the external device, and the hearing prosthesis could be programmed to configure its sound processor based further on the control signal indicating such characteristic(s) of the audio content being output by the external device. As with the indication of visual output from the external device, the control signal indication of audio output from the external device could explicitly or implicitly notify the hearing prosthesis of the type of audio content being output by the device, such as by indicating one or more characteristics of the audio content being output and/or by indicating an application that is running in the foreground of the device and that provides and/or is providing audio content of the particular type, and the hearing prosthesis could set its sound processor to optimize processing for that type of audio content.

By way of example, if the external device is currently outputting audio content with a large dynamic range, such as music or a video soundtrack encoded with an uncompressed audio format or the like, the external device may indicate so in its control signal to the hearing prosthesis, such as by specifying the dynamic range, or by specifying the type of audio content and/or application outputting the audio content in a manner to which the hearing prosthesis would be programmed to respond by setting its sound processor to help optimize processing of such audio. Upon receipt of such a control signal indication, and based at least in part on the indication of the dynamic range of the audio content being output by the external device, the hearing prosthesis may then configure its sound processor accordingly. For instance, the hearing prosthesis may responsively set its sound processor to adjust one or more parameters of an automatic gain control (AGC) algorithm that it applies, such as to apply faster gain-tracking speed or otherwise to adjust gain-tracking speed, and/or to set attack-time, release-time, kneepoint(s), and/or other AGC parameters in a manner appropriate for indicated dynamic range. Further, the hearing prosthesis may responsively set its sound processor to configure one or more frequency filter settings, such as to apply a wide band-pass filter or no band-pass filter, to accommodate input of audio in the indicated frequency range.

As another example, if the external device is currently outputting audio content that is primarily speech content, such as voice call audio or video-conference audio for instance, the external device may indicate so in its control signal to the hearing prosthesis, and, based at least in part on the indication that the audio content is primarily speech content, the hearing prosthesis may responsively set its sound processor to improve intelligibility of the speech. Whereas, if the external device is currently outputting audio content that is not primarily speech content, such as music or video soundtrack content, the external device may indicate so in its control signal, and, based at least in part on that indication, the hearing prosthesis may responsively set its sound processor to improve appreciation of music.

Further, if the external device is currently engaged in a voice call and is or will be outputting associated voice call audio, the device may indicate so in its control signal to the hearing prosthesis, and, based at least in part on that indication, the hearing prosthesis may responsively set its sound processor to process audio content of that type, such as to apply a band-pass filter covering a frequency range typically associated with the voice call audio. For instance, the external device may indicate generally that it is engaged in a voice call or that it is or will be outputting voice call audio, and the hearing prosthesis may responsively set its sound processor to apply a band-pass filter covering a range of about 0.05 kHz to 8 kHz to help process that audio. Further, the external device may indicate more specifically a type of voice call in which it is engaged or a type of voice call audio that it is or will be outputting, and the hearing prosthesis may set its sound processor to apply an associated band-pass filter based on the indicated type. Such an arrangement could help accommodate efficient processing of various types of voice call audio, such as POTS calls (e.g., with a band-pass filter spanning 0.3 kHz to 3.4 kHz), an HD voice call (e.g., with a band-pass filter spanning 0.05 kHz to 7 kHz), and a voice-over-IP call (e.g., with a band-pass filter spanning 0.05 kHz to 8 kHz).

In addition, if the external device is currently outputting audio content with a limited dynamic range, the external device may indicate so in its control signal to the hearing prosthesis, and, based at least in part on that indication, the hearing prosthesis may responsively set its sound processor to process audio content of that type. For instance, the hearing prosthesis may responsively configure its sound processor with particular AGC parameters, such as to apply slower gain tracking.

As still another example, if the external device is currently outputting audio content that is encoded with a particular codec (e.g., G.723.1, G.711, MP3, etc.), the device may indicate so in its control signal to the hearing prosthesis, and, based at least in part on that indication, the hearing prosthesis may responsively set its sound processor to process audio content of that type. For instance, the hearing prosthesis may responsively configure its sound processor to apply a band-pass filter having a particular frequency range typically associated with the audio codec. Alternatively or additionally, if the codec is of limited dynamic range, the hearing prosthesis may configure its sound processor to process the incoming audio with fewer digital DSP clock cycles (e.g., to disregard certain least significant bits of incoming audio samples) and/or to power off certain DSP hardware, which may provide DSP power savings as well. Or the hearing prosthesis may otherwise modify the extent of digital signal processing by its sound processor.

Further, as yet another example, if the external device is currently outputting latency-sensitive audio content, such as if the device is currently running a gaming application and particularly a gaming application including output of gaming audio content, where speed of audible interaction may be important, the device may indicate so in its control signal to the hearing prosthesis, and, based at least in part on that indication, the hearing prosthesis may responsively set its sound processor to reduce or eliminate typical process steps that contribute to latency of sound processing, so as to help reduce latency of sound processing. For instance, the hearing-prosthesis may responsively set its sound processor to modify its rate of digitally sampling the audio input (such as by reprogramming one or more filters to relax sensitivity (e.g., by increasing roll-off, reducing attenuation, and/or increasing bandwidth) so as to reduce the number of filter taps), which may reduce the frequency resolution but which may also may reduce the extent of data buffering and thereby reduce latency of sound processing. Alternatively, the hearing prosthesis could otherwise modify its sampling rate (possibly increasing the sample rate, if that may help to reduce latency.) Alternatively or additionally, the hearing prosthesis could set its sound processor to eliminate or bypass one or more frequency filters, which typically require data buffering.

Numerous other examples of visual output characteristics and/or audio output characteristics are possible as well. Generally, the external device may be programmed with data indicating the characteristics of its visual and/or audio output and/or may be configured to analyze its visual and/or audio output to dynamically determine its characteristics. The external device may then programmatically generate and transmit to the hearing prosthesis a control signal that indicates such characteristics, in a manner that the hearing prosthesis would be programmed to interpret and to which the hearing prosthesis would be programmed to respond as discussed above.

As the external device detects changes in factors such as those discussed above (e.g., changes in the state of the recipient actually or likely looking at output of the external device, changes in characteristics of visual content being output by the external device, changes in characteristics of audio content being output by the external device, etc.), the external device may transmit updated control signals to the hearing prosthesis, and the hearing prosthesis may respond to each such control signal by changing its sound processor settings accordingly.

Further, in certain situations (e.g., depending on the state of the external device), the external device may transmit to the hearing prosthesis a control signal that causes the hearing prosthesis to revert to its original sound processor configuration or enter a sound processor configuration it might otherwise be in at a given moment. For instance, if the external device had responded to a particular trigger condition (e.g., output of particular visual content and/or audio content, and/or one or more other factors such as those discussed above) by transmitting to the hearing prosthesis a control signal that causes the hearing prosthesis to adjust its sound processor settings as discussed above, the external device may thereafter detect an end of the trigger condition (e.g., discontinuation of its output of the visual content and/or audio content, switching off of its display screen or projector, engaging in a power-down routine, or the like) and may responsively transmit to the hearing prosthesis a control signal that causes the hearing prosthesis to undo its sound processor adjustments.

In addition, as the external device monitors the state of recipient visual interaction with the external device, considering factors such as those discussed above, the external device may periodically transmit to the hearing prosthesis control signals like those discussed above. For instance, the external device may be configured to transmit an updated control signal to the hearing prosthesis every 250 milliseconds. To help ensure that a sound processor adjustment would be appropriate (e.g., to help avoid making sound processor adjustments and then shortly thereafter undoing those adjustments), the hearing prosthesis could then be configured to require a certain threshold duration or sequential quantity of control signals (e.g., 2 seconds or 8 control signals in a row) providing the same indication as each other or indications that cause the same sound processor adjustments, as a condition for the hearing prosthesis to then make the associated sound processor adjustment. Further, the hearing prosthesis could be configured to detect an absence of any control signals from the external device (e.g., a threshold duration of not receiving any such control signals and/or non-receipt of a threshold sequential quantity of control signals) and, in response, to automatically revert to its original sound processor configuration or enter a sound processor configuration it might otherwise be in at a given moment. Moreover, the hearing prosthesis and/or external device may be configured to allow recipients or recipient caregivers to override any control signaling or sound processor adjustments.

The external device and/or hearing prosthesis could also be arranged to not engage in aspects of this process in certain scenarios, such as when the recipient's visual interaction with output of the external device is of a type that would typically be short-lived, to help avoid making a change to the sound processor configuration that would be shortly thereafter undone. Examples of such scenarios could include the recipient interacting with the external device to simply adjust settings (e.g., to adjust volume, equalizer settings), to make a song or video choice, to enter a password, to browse through apps, mistakenly opening and then quickly closing an app, or the like.

In practice, the external device could be configured to detect that the recipient is engaging in such fleeting interaction with the external device and to responsively not transmit to the hearing prosthesis an associated control signal. Alternatively, the external device could respond to detecting such fleeting interaction by transmitting to the hearing prosthesis a control signal that indicates the type of interaction, in which case the hearing prosthesis could then responsively not adjust its sound processor configuration.

Still alternatively, the hearing prosthesis could be configured to apply no, reduced or less noticeable sound processor adjustments (e.g., a reduced extent of microphone beamforming, etc.) in response to a control signal from the external device indicating a type of recipient interaction with the external device that is likely to involve a reduced extent of visual interaction with or recipient concentration on output of the external device, such as adjusting settings (volume, equalizer, etc.). In some such scenarios, the recipient may wish to maintain or otherwise benefit from the existing sound processor configuration and the corresponding ability to perceive sound from one or more sources other than the external device.

The control signal that the external device transmits to the hearing prosthesis in accordance with the present disclosure can take any of a variety of forms. Optimally, the control signal would provide one or more indications as discussed above in any way that the hearing prosthesis would be configured to interpret and to which the hearing prosthesis would be configured to respond accordingly. By way of example, both the external device and the hearing prosthesis could be provisioned with data that defines codes, values, or the like to represent particular states, such as to generally indicate that the recipient is actually or likely looking at an output of the external device and/or to indicate one or more characteristics of visual output and/or audio output from the external device. Thus, the external device may use such codes, values or the like to provide one or more indications in the control signal, and the hearing prosthesis may correspondingly interpret the codes, values, or the like, and respond accordingly. Moreover, such a control signal may actually comprise one or more control signals that cooperatively provide the desired indication(s).

In addition, the external device can transmit the control signal to the hearing prosthesis in any of a variety of ways. In the arrangement depicted in FIG. 1, for instance, where the external device has a display providing visual output and a speaker providing the audio output, the external device could transmit the control signal to the hearing prosthesis separate and apart from the visual and audio output, over its wireless communication link with the hearing prosthesis for example. As such, the control signal could be encapsulated in an applicable wireless link communication protocol for wireless transmission, and the hearing prosthesis could receive the transmission, strip the wireless link encapsulation, and uncover the control signal.

Alternatively, the external device could integrate the control signal with its visual output and/or audio output in some manner. For instance, the external device could modulate the control signal on an audio frequency that is outside the range the hearing prosthesis would normally process for hearing stimulation, but the hearing prosthesis, such as its sound processor, could be arranged to detect and demodulate communication on that frequency so as to obtain the control signal.

Further, in an alternative arrangement, the external device may be arranged to transmit audio to the hearing prosthesis via the wireless communication link 30, e.g., as a digital audio stream, and the hearing prosthesis may be arranged to receive the transmitted audio and to process the audio in much the same way that the hearing prosthesis would process analog audio input received at one or more microphones, possibly without a need to digitally sample, or with an added need to transcode the audio signal. In such an arrangement, the external device could provide the control signal as additional data, possibly multiplexed or otherwise integrated with the audio data, and the hearing prosthesis could be arranged to extract the control signal from the received data.

Note also that the control signal transmission from the external device to the hearing prosthesis could pass through one or more intermediate nodes. For instance, the external device could transmit the control signal to another device associated with the recipient of the hearing prosthesis, and that other device could then responsively transmit the control signal to the hearing prosthesis. This arrangement could work well in a scenario where the hearing prosthesis interworks with an supplemental processing device of some sort, as the external device could transmit the control signal to that supplemental device, and the supplemental device could transmit the control signal in turn to the hearing prosthesis.

In addition, note that the visual and/or audio output from the external device could come directly from the external device as shown in FIG. 1 or could come from another location. By way of example, the external device could project its visual output for display on a separate screen or otherwise at some distance from the external device, and could provide corresponding audio output to the hearing prosthesis (i) from a speaker positioned on the external device or at or near the projected display or (ii) via the wireless communication interface 30. Certain functions discussed above could then still apply in that arrangement, as the recipient may still be looking at, or visually focused on, the output of the external device, such that the sound processor of the hearing prosthesis is configured to process audio coming or originating from the external device and/or to otherwise adjust sound processing by the hearing prosthesis as discussed above.

Figure 2:
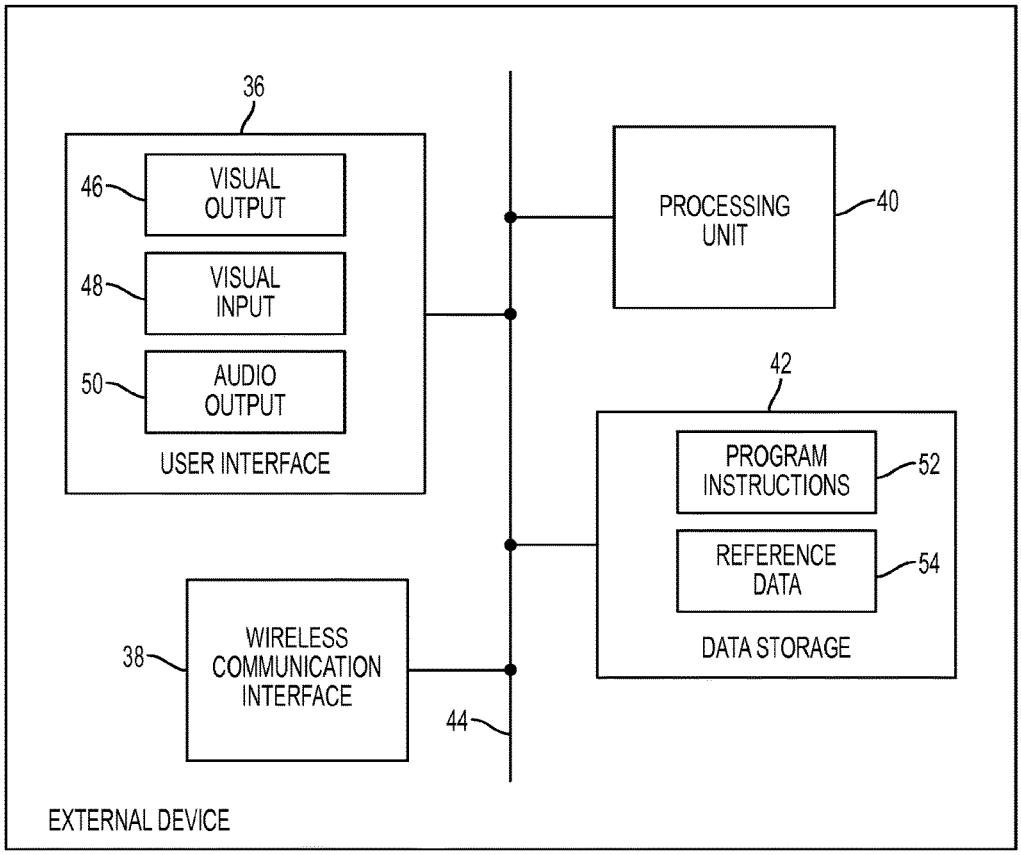
FIG. 2 is a simplified block diagram depicting components of an example external device.

In practice, the external device could be any of a variety of handheld computing devices or other devices, examples of which include a cellular telephone, a camera, a gaming device, an appliance, a tablet computer, a desktop or portable computer, a television, a movie theater, or another sort of device or combination of devices (e.g., phones, tablets, or other devices docked with laptops or coupled with various types of external audio-visual output systems) now known or later developed. FIG. 2 is a simplified block diagram showing some of the components that could be included in such an external device to facilitate carrying out various functions as discussed above. As shown in FIG. 2, the example external device includes a user interface 36, a wireless communication interface 38, a processing unit 40, and data storage 42, all of which may be communicatively linked together by a system bus, network, or other connection mechanism 44.

With this arrangement as further shown, user interface 36 may include a visual output interface 46, such as a display screen or projector configured to present visual content, or one or more components for providing visual output of other types. Further, the user interface may include a visual input interface 48, such as a video camera, which the external device might be arranged to use as a basis to engage in eye-tracking as discussed above, and/or to facilitate capture of still and/or video images. In addition, the user interface may include an audio output interface 50, such as a sound speaker or digital audio output circuit configured to provide audio output that could be received and processed as audio input by the recipient's hearing prosthesis.

The wireless communication interface 38 may then comprise a wireless chipset and antenna, arranged to pair with and engage in wireless communication with a corresponding wireless communication interface in the hearing prosthesis according to an agreed protocol such as one of those noted above. For instance, the wireless communication interface could be a BLUETOOTH radio and associated antenna or an infrared transmitter, or could take other forms.

Processing unit 40 may then comprise one or more processors (e.g., application specific integrated circuits, or programmable logic devices, etc.) Further, data storage 42 may comprise one or more volatile and/or non-volatile storage components, such as magnetic, optical, or flash storage and may be integrated in whole or in part with processing unit 40. As shown, data storage 42 may hold program instructions 52 executable by the processing unit to carry out various external device functions described herein, as well as reference data 54 that the processing unit may reference as a basis to carry out various such functions.

By way of example, the program instructions may be executable by the processing unit to facilitate wireless pairing of the external device with the hearing prosthesis. Further, the program instructions may be executable by the processing unit to detect that the recipient is actually or likely looking at the output of the external device in any of the ways discussed above for instance, and to responsively generate and transmit to the hearing prosthesis a control signal providing one or more indications as discussed above, to cause the hearing prosthesis to configure its sound processor accordingly. As noted above, for instance, the external device could provide such a control signal through its wireless communication link with the hearing prosthesis, or through modulation of an analog audio output for instance.

Figure 3:
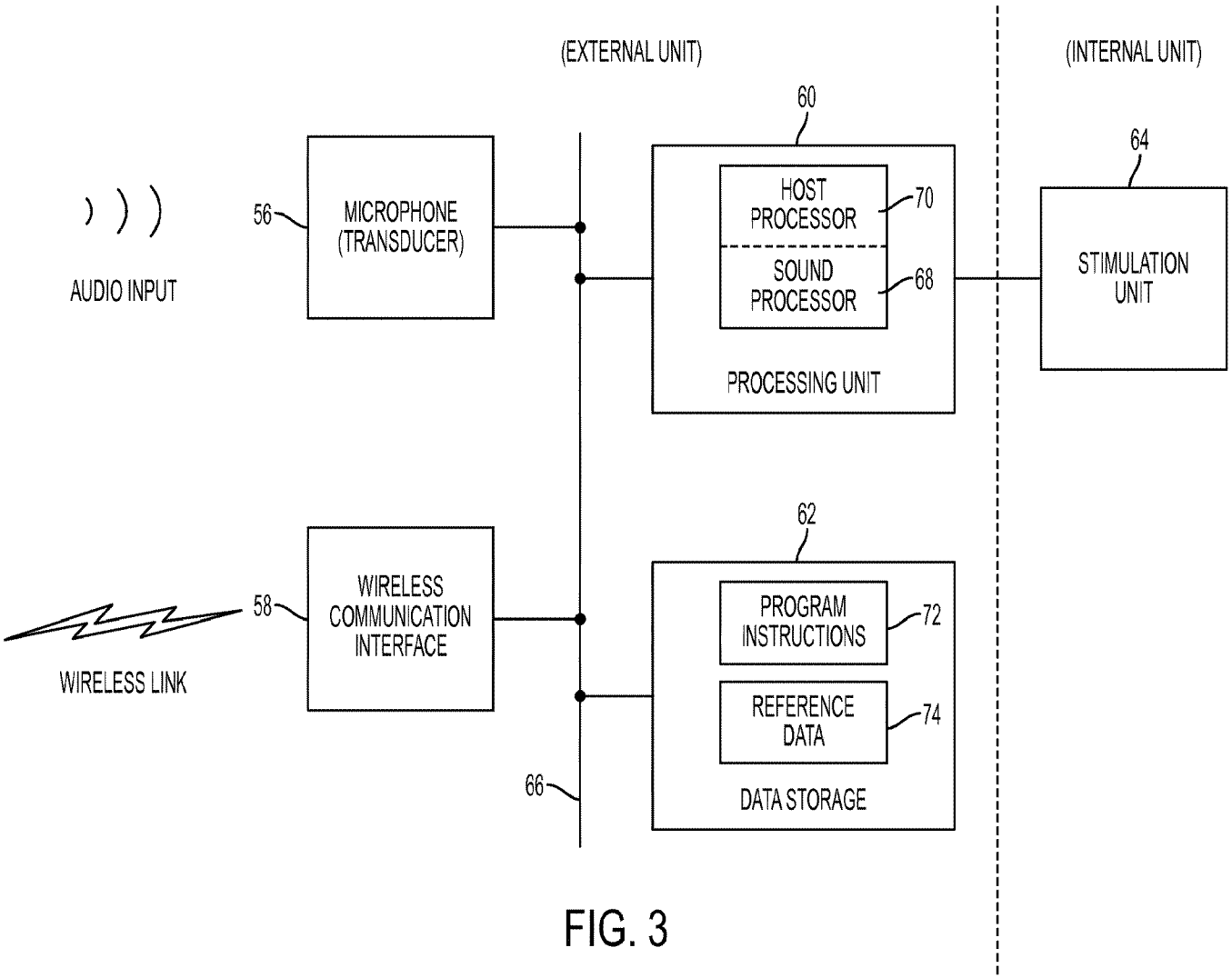
FIG. 3 is a simplified block diagram depicting components of an example hearing prosthesis.

The hearing prosthesis, in turn, can also take any of a variety of forms, examples of which include, without limitation, those discussed in the background section above. FIG. 3 is a simplified block diagram depicting components of such a hearing prosthesis to facilitate carrying out various functions as described above.

As shown in FIG. 3, the example hearing prosthesis includes a microphone (or other audio transducer) 56, a wireless communication interface 58, a processing unit 60, data storage 62, and a stimulation unit 64. In the example arrangement, the microphone 56, wireless communication interface 58, processing unit 60, and data storage 62 are communicatively linked together by a system bus, network, or other connection mechanism 66. Further, the processing unit is then shown separately in communication with the stimulation unit 64, although in practice the stimulation unit could also be communicatively linked with mechanism 66.

Depending on the specific hearing prosthesis configuration, these components could be provided in or more physical units for use by the recipient. As shown parenthetically and by the vertical dashed line in the figure, for example, the microphone 56, wireless communication interface 58, processing unit 60, and data storage 62 could all be provided in an external unit, such as a behind-the-ear unit configured to be worn by the recipient, and the stimulation unit 64 could be provided as an internal unit, such as a unit configured to be implanted in the recipient for instance. With such an arrangement, the hearing prosthesis may further include a mechanism, such as an inductive coupling, to facilitate communication between the external unit and the external unit. Alternatively, as noted above, the hearing prosthesis could take other forms, including possibly being fully implanted, in which case some or all of the components shown in FIG. 3 as being in an external unit could instead be provided internal to the recipient. Other arrangements are possible as well.

In the arrangement as shown, the microphone 56 may be arranged to receive audio input, such as audio coming from the external device as discussed above, and to provide a corresponding signal (e.g., electrical or optical, possibly sampled) to the processing unit 60. Further, microphone 56 may comprise multiple microphones or other audio transducers, which could be positioned on an exposed surface of a behind-the-ear unit as shown by the dots on the example hearing prosthesis in FIG. 1. Use of multiple microphones like this can help facilitate microphone beamforming in the situations noted above for instance.

Wireless communication interface 58 may then comprise a wireless chipset and antenna, arranged to pair with and engage in wireless communication with a corresponding wireless communication interface in another device such as the external device discussed above, again according to an agreed protocol such as one of those noted above. For instance, the wireless communication interface 58 could be a BLUETOOTH radio and associated antenna or an infrared receiver, or could take other forms.

Further, stimulation unit 64 may take various forms, depending on the form of the hearing prosthesis. For instance, if the hearing prosthesis is a hearing aid, the stimulation unit may be a sound speaker for providing amplified audio. Whereas, if the hearing prosthesis is a cochlear implant, the stimulation unit may be a series of electrodes implanted in the recipient's cochlea, arranged to deliver stimuli to help the recipient perceive sound as discussed above. Other examples are possible as well.

Processing unit 60 may then comprise one or more processors (e.g., application specific integrated circuits, programmable logic devices, etc.) As shown, at least one such processor functions as a sound processor 68 of the hearing prosthesis, to process received audio input so as to enable generation of corresponding stimulation signals as discussed above. Further, another such processor 70 of the hearing prosthesis could be configured to receive a control signal via the wireless communication interface or as modulated audio as discussed above and to responsively configure or cause to be configured the sound processor 68 in the manner discussed above. Alternatively, all processing functions, including receiving and responding to the control signal, could be carried out by the sound processor 68 itself.

Data storage 62 may then comprise one or more volatile and/or non-volatile storage components, such as magnetic, optical, or flash storage, and may be integrated in whole or in part with processing unit 60. As shown, data storage 62 may hold program instructions 72 executable by the processing unit 60 to carry out various hearing prosthesis functions described herein, as well as reference data 74 that the processing unit 60 may reference as a basis to carry out various such functions.

By way of example, the program instructions 72 may be executable by the processing unit 60 to facilitate wireless pairing of the hearing prosthesis with the external device. Further, the program instructions may be executable by the processing unit 60 to carry out various sound processing functions discussed above including but not limited to sampling audio input, applying frequency filters, applying automatic gain control, and applying microphone-beamforming, and outputting stimulation signals, for instance. Many such sound processing functions are known in the art and therefore not described here. Optimally, the sound processor 68 may carry out many of these functions in the digital domain, applying various digital signal processing algorithms with various settings to process received audio and generate stimulation signal output. However, certain sound processor functions, such as particular filters, for instance, could be applied in the analog domain, with the sound processor 68 programmatically switching such functions on or off (e.g., into or out of an audio processing circuit) or otherwise adjusting configuration of such functions.

Figure 4:
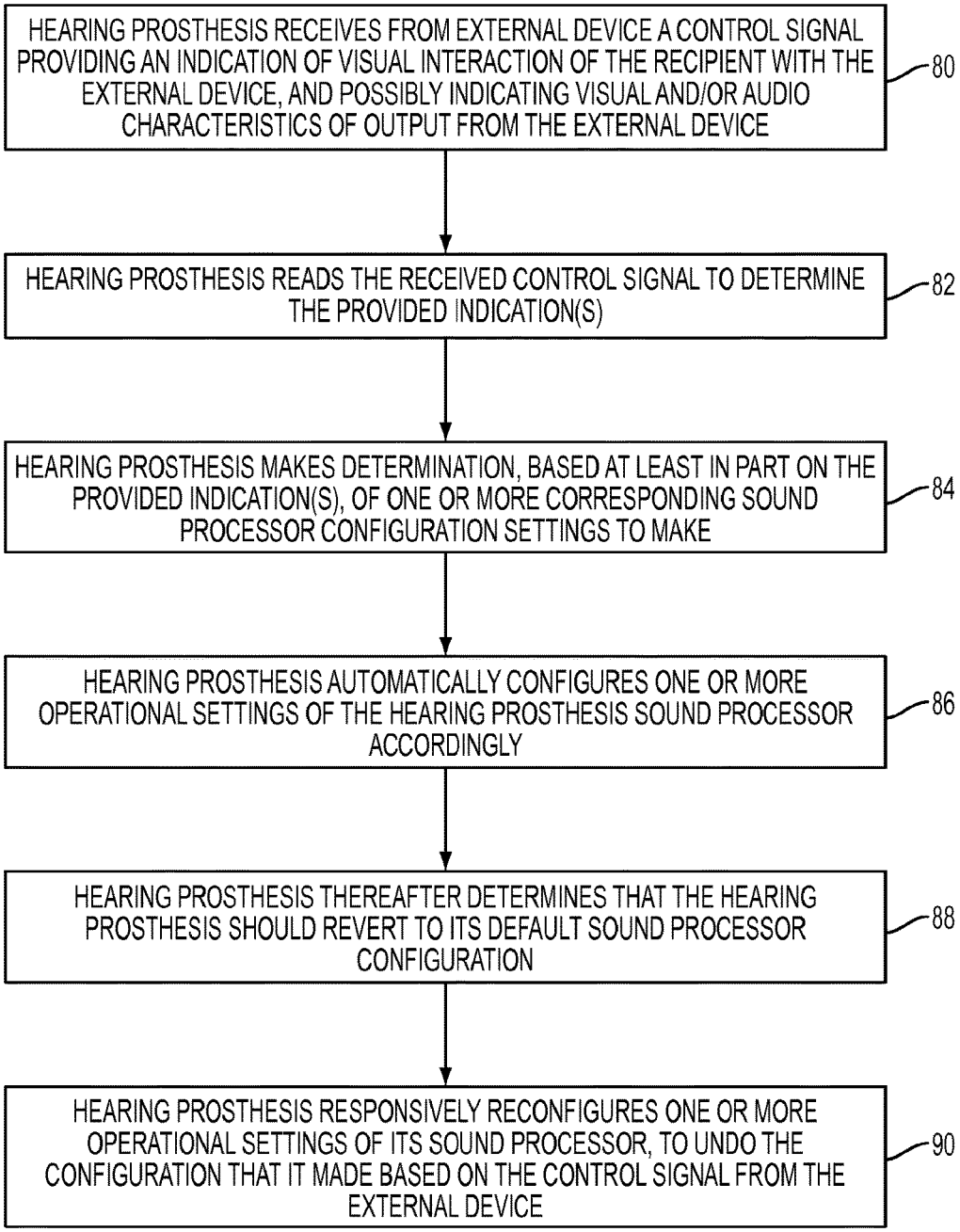
FIG. 4 is a flow chart depicting functions that can be carried out in accordance with the present disclosure.

Finally, FIG. 4 is a flow chart depicting functions that can be carried out in accordance with the discussion above, to facilitate automated configuration of a hearing prosthesis sound processor based on visual interaction with an external device. As shown in FIG. 4, at block 80, processing unit 60 of the hearing prosthesis receives from an external device a control signal that provides an indication of visual interaction of the recipient with the external device (e.g., that the recipient is looking in a direction of the external device, that the recipient is looking at output of the external device, and/or that the recipient is at least visually (and perhaps auditorily) focused on output of the external device), perhaps including an indication of one or more characteristics of visual output and/or audio output from the external device, as discussed above.

At block 82, the processing unit of the hearing prosthesis then reads the received control signal to determine what the control signal indicates, such as whether it indicates that the recipient is visually interacting with the external device, that visual output from the external device has one or more particular characteristics, and/or that audio output from the external device has one or more particular characteristics. At block 84, the processing unit 60 then makes a determination, based at least in part on the indication(s) provided by the control signal, of one or more corresponding sound processor configuration settings for the hearing prosthesis. And at block 86, the processing unit 60 then automatically configures (e.g., sets, adjusts, or otherwise configures) one or more operational settings of the sound processor 68 accordingly.

In turn, at block 88, the processing unit 60 may thereafter determine as discussed above that the hearing prosthesis should revert to its default sound processor configuration, i.e., to the sound processor configuration that the hearing prosthesis had before processing unit 60 changed the configuration based on the received control signal or the sound processor configuration it might otherwise be in at a given moment. And at block 90, the processing unit 60 may then responsively reconfigure one or more operational settings of the sound processor to undo the configuration that it made based on the control signal from the external device.

Exemplary embodiments have been described above. It should be understood, however, that numerous variations from the embodiments discussed are possible, while remaining within the scope of the invention.

What is claimed is:

1. A method comprising:

receiving into a hearing prosthesis, from an external device associated with a recipient of the hearing prosthesis, a control signal indicating that the recipient is looking at an output of the external device; and responsive to receipt of the control signal, the hearing prosthesis automatically configuring a sound processor of the hearing prosthesis in a manner based at least in part on the control signal indicating that the recipient is looking at the output of the external device, wherein the external device is outputting visual content, the control signal indicates at least one characteristic of the visual content being output by the external device, and wherein automatically configuring the sound processor of the hearing prosthesis is further based at least in part on the control signal indicating the at least one characteristic of the visual content being output by the external device, and the at least one characteristic of the visual content comprises the visual content being text-based content, and wherein automatically configuring the sound processor of the hearing prosthesis based at least in part on the control signal indicating the at least one characteristic of the visual content being output by the external device comprises at least one function that is at least one of:

based at least in part on the control signal indicating that the visual content is text-based, automatically configuring the sound processor to reduce gain of the sound processor;

based at least in part on the control signal indicating that the visual content is text-based, automatically reducing a stimulation rate of the sound processor; or based at least in part on the control signal indicating that the visual content is text-based, automatically increasing a noise reduction level of the sound processor.

2. The method of claim 1, wherein the control signal indicates that the recipient is looking at the output of the external device at least in part by indicating that the external device is outputting visual content, and wherein automatically configuring the sound processor of the hearing prosthesis based at least in part on the control signal indicating that the recipient is looking at the output of the external device comprises:

automatically configuring the sound processor of the hearing prosthesis based at least in part on the control signal indicating that the external device is outputting visual content.

3. The method of claim 2, wherein the control signal indicates that the external device is outputting visual content at least in part by indicating that the external device is running an in-focus application of a type that outputs visual content.

4. The method of claim 1, wherein a subsequent signal received by the hearing prosthesis indicates at least one characteristic of a subsequent visual content being output by the external device, and the method further includes subsequently automatically configuring the sound processor of the hearing prosthesis based at least in part on the subsequent signal indicating the at least one characteristic of the subsequent visual content being output by the external device, and wherein the at least one characteristic of the visual content comprises image capture content, and wherein automatically configuring the sound processor of the hearing prosthesis based at least in part on the control signal indicating the at least one characteristic of the visual content being output by the external device comprises:

based at least in part on the control signal indicating that the visual content comprises image capture content, automatically configuring the sound processor to apply microphone-beamforming to focus on audio coming from in front of the recipient.

5. The method of claim 2, wherein the control signal further indicates that the external device is outputting audio content associated with the visual content, and wherein the automatic configuring of the sound processor is additionally based at least in part on the control signal indicating that the external device is outputting audio content associated with the visual content.

6. The method of claim 5, wherein automatically configuring the sound processor based at least in part on the control signal indicating that external device is outputting audio content associated with the visual content comprises:

based at least in part on control signal indicating that external device is outputting audio content associated with the visual content, automatically configuring the sound processor to apply microphone-beamforming to focus on audio coming from the external device in front of the recipient.

7. The method of claim 5, wherein the control signal indicates at least one characteristic of the audio content being output by the external device, and wherein automatically configuring the sound processor of the hearing prosthesis is further based at least in part on the control signaling indicating the at least one characteristic of the audio content being output by the external device.

8. The method of claim 7, wherein the at least one characteristic of the audio content comprises the audio content being encoded with a particular codec, and wherein automatically configuring the sound processor of the hearing prosthesis based at least in part on the control signal indicating the at least one characteristic of the audio content being output the by the external device comprises a function selected from the group consisting of:

based at least in part on the control signal indicating that the audio content is encoded with the particular codec, automatically setting the sound processor to apply a particular bandpass filter, and based at least in part on the control signal indicating that the audio content is encoded with the particular codec, automatically modifying an extent of digital signal processing.

9. The method of claim 1, wherein the external device is a handheld computing device operable by the recipient.

10. A hearing prosthesis comprising:

at least one microphone for receiving audio input;

a sound processor for processing the audio input and generating corresponding hearing stimulation signals to stimulate hearing in a human recipient of the hearing prosthesis; and a wireless communication interface, wherein the hearing prosthesis is configured to receive from an external device associated with the recipient, via the wireless communication interface, a control signal indicating that the recipient is focused at least visually on an output of the external device, and to respond to the received control signal by automatically configuring the sound processor in a manner based at least in part on the control signal indicating that the recipient is focused at least visually on the output of the external device, whereby the automatic configuring of the sound processor accommodates processing of the audio input when the audio input comprises audio content output from the external device.

11. The hearing prosthesis of claim 10, wherein the control signal indicates that the recipient is focused at least visually on the output of the external device at least in part by indicating that the external device is outputting visual content, and wherein automatically configuring the sound processor in a manner based at least in part on the control signal indicating that the recipient is focused at least visually on the output of the external device comprises automatically configuring the sound processor based at least in part on the control signal indicating that the external device is outputting visual content.

12. The hearing prosthesis of claim 11, wherein the control signal indicates that the external device is outputting visual content at least in part by indicating that the external device is running an in-focus application of a type that outputs visual content.

13. The hearing prosthesis of claim 11, wherein the control signal indicates at least one characteristic of the visual content being output by the external device, and wherein automatically configuring the sound processor is further based at least in part on the control signal indicating the at least one characteristic of the visual content being output by the external device.

14. The hearing prosthesis of claim 10, wherein the control signal further indicates that the external device is outputting the audio content, and wherein automatically configuring the sound processor is further based at least in part on the control signal indicating that the external device is outputting the audio content.

15. A system comprising:

a hearing prosthesis including a wireless communication interface, a microphone for receiving sound and a sound processor for processing received audio input, including audio input from the microphone, and generating hearing stimulation signals for a recipient of the hearing prosthesis; and a computing device associated with the recipient, wherein, the computing device is configured to output visual content viewable by the recipient, and wherein the computing device is configured to transmit to the hearing prosthesis a control signal indicating that the recipient is looking in a direction of the computing device, and wherein, the hearing prosthesis is configured to receive, via the wireless communication interface, the signal and in response, automatically configure the sound processor in a manner based at least in part on the control signal indicating that the recipient is looking in the direction of computing device so that a resulting hearing percept evoked by the hearing prosthesis based on sound originating from a location other than the computing device is different relative to that which would be the case in the absence of receipt of the signal.

16. The system of claim 15, wherein the control signal indicates that the recipient is looking in the direction of the computing device at least in part by indicating that the computing device is outputting visual content.

17. The system of claim 15, wherein the computing device is further configured to output audio content associated with the visual content, wherein the audio input represents at least the audio content, wherein the control signal further indicates at least one characteristic of the audio content, and wherein automatically configuring the sound processor is further based at least in part on the control signal indicating the at least one characteristic of the audio content.

18. The method of claim 1, wherein the control signal is not a configuration signal that configures the hearing prosthesis.

19. The method of claim 1, wherein the hearing prosthesis is pre-programmed to operate according to two or more respective operating regimes, at least one of which is automatically enabled upon the hearing prosthesis determining that it has received the control signal.

20. The method of claim 1, wherein the action of automatically configuring the sound processor is executed based on an analysis of the control signal by the hearing prosthesis in a non-slave manner vis-à-vis a master-slave control regime.

21. The method of claim 1, wherein the action of automatically configuring the sound processor is executed based on an analysis of the control signal by the hearing prosthesis in a slave manner vis-à-vis a master-slave control regime.

22. The method of claim 7, wherein the at least one characteristic of the audio content comprises the audio content including latency-sensitive audio content, and wherein automatically configuring the sound processor of the hearing prosthesis based at least in part on the control signal indicating the at least one characteristic of the audio content being output by the external device comprises:

based at least in part on the control signal indicating that the audio content comprises latency-sensitive audio content, automatically adjusting at least one sound processor setting to help reduce latency of sound processing.

23. The method of claim 22, wherein the latency-sensitive audio content comprises gaming audio content.

24. The system of claim 15, wherein the system is devoid of eye-tracking technology.

25. The method of claim 1, wherein:

during the actions of receiving and automatically configuring, the sound processor of the hearing prosthesis is controlled by the hearing prosthesis.

26. The method of claim 1, wherein the action of receiving and automatically configuring are executed while the recipient is holding the external device while the recipient is looking at the device viewing text output.

27. The method of claim 1, further comprising:

automatically configuring the sound processor of the hearing prosthesis in a different manner in the complete absence of the control signal, wherein the hearing prosthesis evokes a hearing percept while configured in the different manner.

28. The method of claim 1, wherein the control signal indicates that the recipient is looking at the output of the external device at least in part by indicating that the external device is outputting no visual content, and wherein automatically configuring the sound processor of the hearing prosthesis based at least in part on the control signal indicating that the recipient is looking at the output of the external device comprises:

automatically configuring the sound processor of the hearing prosthesis based at least in part on the control signal indicating that the external device is outputting visual content.

29. The method of claim 1, wherein the control signal further indicates that the external device is outputting audio content associated with the visual content, and wherein the automatic configuring of the sound processor is additionally based at least in part on the control signal indicating that the external device is outputting audio content associated with the visual content.

30. The method of claim 1, wherein the action of receiving and automatically configuring are executed while the recipient is holding the external device while the recipient is looking at the device watching video media content.

31. The system of claim 15, wherein the control signal indicates that the recipient is looking in the direction of the computing device at least in part by indicating that the computing device is outputting visual content, and wherein the computing device is further configured to output audio content associated with the outputted visual content, wherein the audio input represents at least the audio content, wherein the control signal further indicates at least one characteristic of the audio content, and wherein automatically configuring the sound processor is further based at least in part on the control signal indicating the at least one characteristic of the audio content.

32. The method of claim 1, wherein the external device is a television.

33. The method of claim 1, wherein the action of receiving and automatically configuring are executed while the hearing prosthesis operates autonomously from the external device.

* * * * *